US006035548A

United States Patent [19]

Rae

[11] Patent Number: 6,035,548

[45] Date of Patent: Mar. 14, 2000

[54] UV DRYER WITH IMPROVED REFLECTOR

[75] Inventor: Malcolm Charles Rae, Reigate, United Kingdom

[73] Assignee: GEW (EC) Limited, Surrey, United Kingdom

[21] Appl. No.: 09/155,657

[22] PCT Filed: Apr. 2, 1997

[86] PCT No.: PCT/GB97/00940

§ 371 Date: Apr. 2, 1999

§ 102(e) Date: Apr. 2, 1999

[87] PCT Pub. No.: WO97/38275

PCT Pub. Date: Oct. 16, 1997

[30] Foreign Application Priority Data

Apr. 4, 1996 [GB] United Kingdom ..... 9607129

[51] Int. Cl.[7] ..... F26B 3/34

[52] U.S. Cl. ..... 34/274; 34/278; 101/424.1; 101/488

[58] Field of Search ..... 34/266, 267, 273, 34/274, 275, 277, 278; 101/424.1, 488; 362/263, 293; 250/504 R; 427/508, 560; 313/492, 493, 503; 315/169.4, 169.3

[56] References Cited

U.S. PATENT DOCUMENTS

| | | | |
|---|---|---|---|
| 3,757,662 | 9/1973 | Ingels | 34/274 X |
| 4,048,490 | 9/1977 | Troue | 362/263 |
| 4,070,499 | 1/1978 | Ramler | 427/54 |
| 5,546,679 | 8/1996 | Keller | 34/278 |
| 5,595,118 | 1/1997 | Villaverde, Sr. et al. | 34/278 X |
| 5,713,138 | 2/1998 | Rudd | 34/274 |
| 5,732,477 | 3/1998 | Toyama | 34/274 X |
| 5,751,008 | 5/1998 | Jung et al. | 34/278 X |

*Primary Examiner*—Stephen Gravini
*Attorney, Agent, or Firm*—Sughrue, Mion, Zinn, Macpeak & Seas, PLLC

[57] ABSTRACT

This invention relates to UV dryers and provides an ultraviolet dryer wherein a UV lamp (2) is supported in a reflector housing (1), said housing including a reflector body member (10) having a reflective surface adjacent the lamp (2) and other surfaces spaced therefrom and cooling means (11) for passing a cooling medium over said other surfaces to cool said body member, wherein the reflective surface comprises a thin, flexible strip of heat-conductive sheet material (12) bearing dichroic film, said film exhibiting a high degree of transmission towards infrared radiation and high degreee of reflection toward UV radiation.

8 Claims, 2 Drawing Sheets

UV DRYER WITH IMPROVED REFLECTOR

Figure 1:
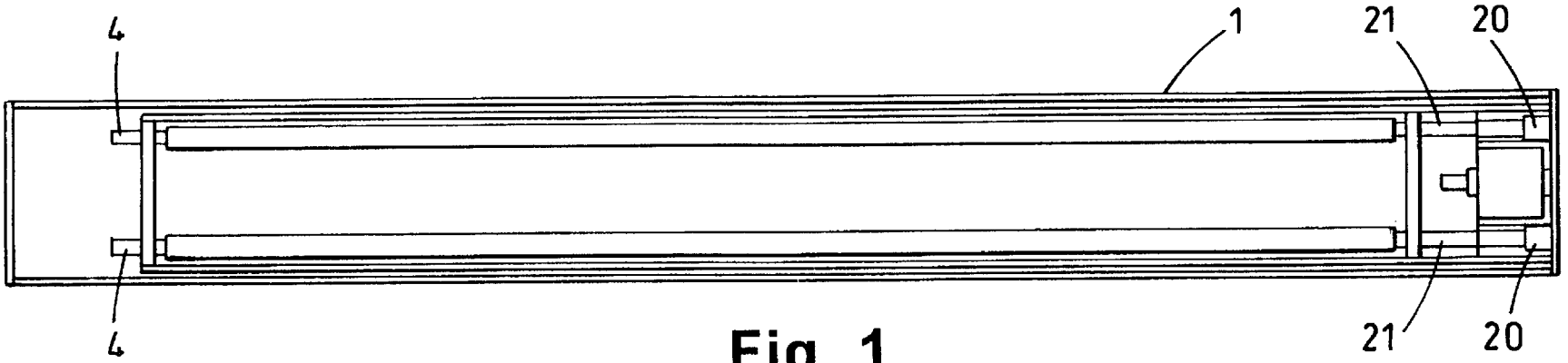

This invention relates to UV dryers, in particular, for use with high speed printing machines.

UV dryers are frequently used in the printing industry for drying photopolymerisable inks. When used with high speed printing machines, a lamp or bank of lamps having a high UV output is required, in order to cure the inks during the short time when the sheets are passing the mouth of the dryer. Unfortunately, UV lamps also emit a substantial amount of heat and the larger or longer the lamp, the greater the amount of waste heat which needs to be disposed of. The present invention seeks to provide a solution to this problem.

U.S. Pat. No. 4,048,490 describes a UV dryer having a conventional parabolic reflector. A plurality of optically flat dichroic filters are mounted beyond the parabolic reflector and are arranged in conjunction with a reflective cusp to ensure that light rays from the UV lamp are reflected from at least two surfaces before reaching the surface to be irradiated.

U.S. Pat. No. 4,070,499 describes an array of UV lamps mounted within adjoining elliptical reflectors. The reflectors may be cooled by coolant media circulated through tubes in contact with the back surfaces of the reflectors.

EP-A-0134591 describes a UV dryer in which a lamp is mounted in a parabolic reflector and a cooling air flow is directed between the reflector surface and the lamp envelope.

According to one aspect of the present invention, there is provided a UV dryer for drying photopolymerisable ink on a web wherein a UV lamp is supported within a reflector housing, said housing including a reflector body having curved reflector surfaces disposed to reflect UV light onto a web, characterised in that each of the reflector surfaces comprises a thin, flexible heat conductive metal strip, bearing a dichroic film on one side which is adjacent the lamp and wherein the strip is deformed so that the opposite side is in close contact with said reflector body, said dichroic film exhibiting a high degree of transmission towards infra-red radiation and a high degree of reflection towards UV radiation and said reflector body having other surfaces spaced from said reflector surfaces and cooling means are provided for passing a cooling medium over said other surfaces to cool the reflector body.

The reflective surface of the reflector comprises a thin, flexible, polished metal strip of heat-conductive material e.g. stainless steel, having one surface disposed for reflecting UV light towards the printed sheets or web, and the other in close contact with the reflector housing. The reflector housing may be air or water cooled and, because the dicroic film is transmissive towards infra-red radiation, the underlying metal strip becomes hot and heat is conducted from the strip of sheet material to the reflector body member. By arranging for air-cooling fins or water-cooling passages to be positioned close to the surface of the reflective body member which is in close contact with the flexible substrate, efficient transfer of heat to the cooling medium is achieved. As a further aid to heat transfer, a heat-conductive paste may be applied to the back surface of the strip. The strip is fastened to the body member in such a way as to ensure close contact of the back surface of the strip with the corresponding surface of the body member. Where a paste is present, the fastening device ensures that the paste is squeezed between the contacting surfaces.

The provision of a reflector which is a thin flexible sheet material is advantageous because there are difficulties in coating dichroic films onto curved surfaces. In accordance with this invention, the dichroic film is coated onto a flat metal sheet which is then deformed to take up the same curvature as the reflector body member.

According to another feature of the invention, the UV dryer is preferably cooled using water. In one embodiment of the invention the UV dryer includes movable shutters to close off the reflector mouth when the web is stationary. Under such conditions, the shutters can become extremely hot and they are preferably cooled in accordance with this invention by passing a water-cooling stream along the pivot axis of the shutter blades.

One embodiment of a dryer in accordance with the invention will now be described with reference to the accompanying drawings, in which:-

Figure 2:
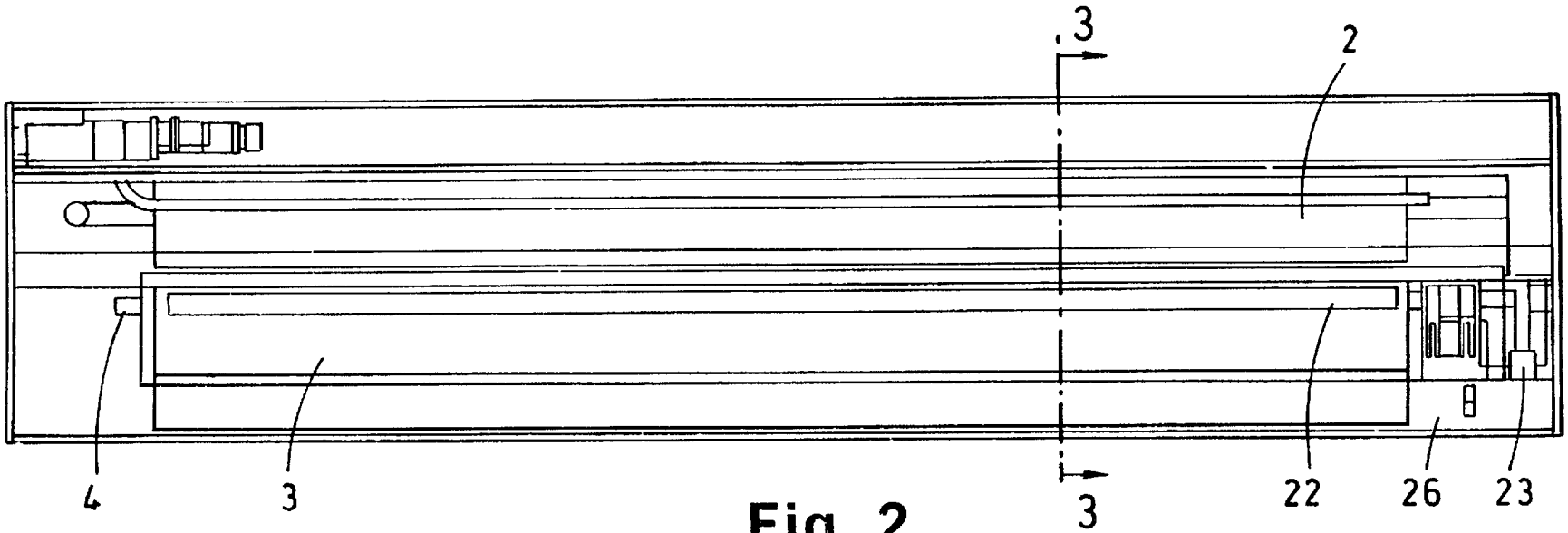
Figure 3:
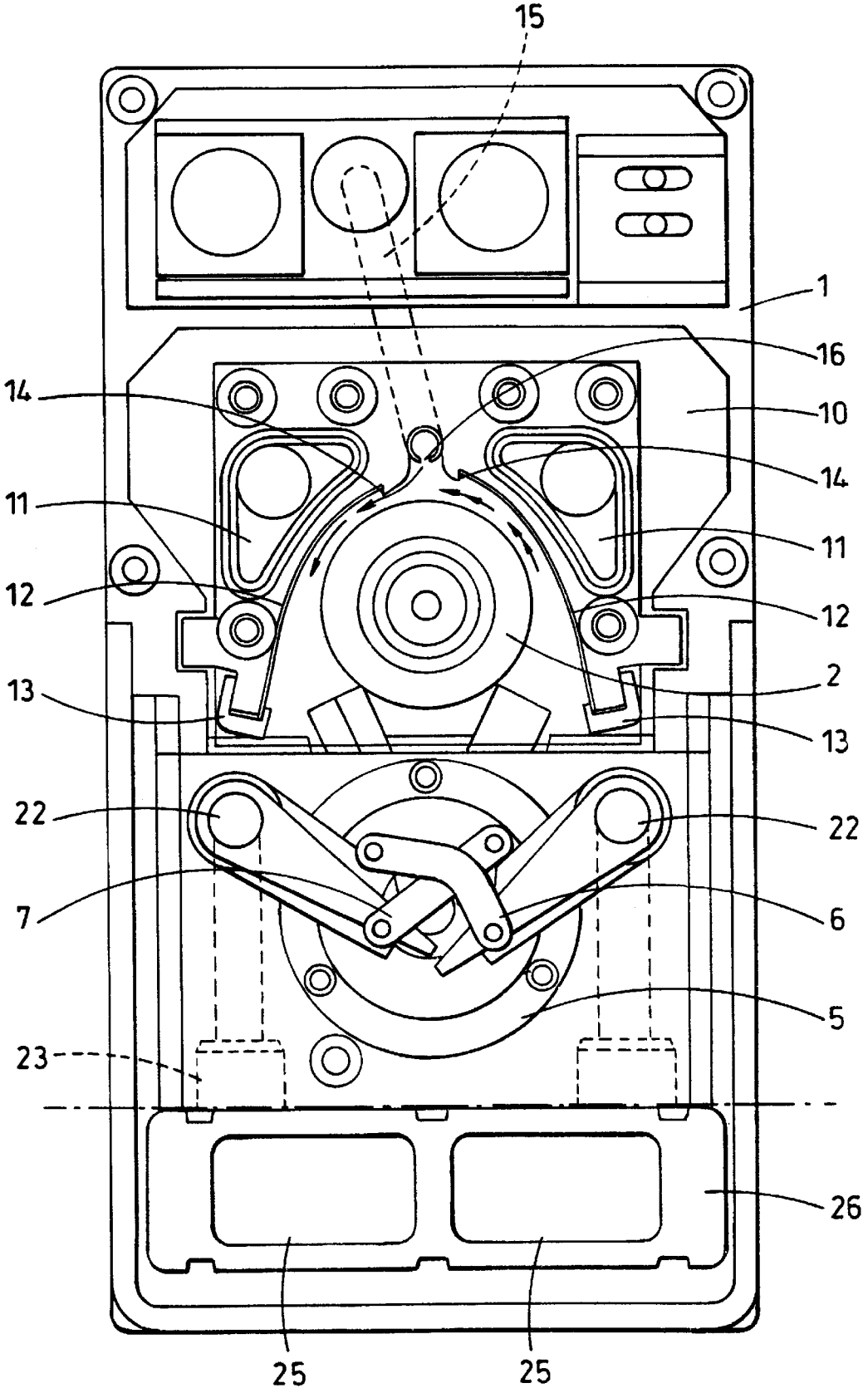

FIG. 1 is a plan view of the dryer showing the arrangements for conducting cooling water to the shutter blades, FIG. 2 is a side elevation, partly in section, showing the dryer shown in FIG. 1, and FIG. 3 is a view on the line 3—3 in FIG. 2, showing details of the internal construction of the dryer on a larger scale.

Referring to the drawings, the dryer comprises a housing (1) in which a UV lamp (2) is mounted and the housing includes a pair of shutter blades (3), pivoted on an axis (4).

Details of the construction of the dryer shown in FIG. 3 from which it will be noted that the movement of the shutter blades is controlled by a disc (5), which is rotatable by an air, electric or hydraulic motor, not shown, in order to open and shut the shutters using linkage arms (6 and 7). The details of the operation of the shutter blades and their construction is described in our PCT application WO 93/02329.

Mounted within the housing (1) is an extrusion or casting (10) forming a reflector body, preferably manufactured from an aluminum or an aluminum alloy, having longitudinally arranged water jackets (11) through which water can be circulated to remove heat from the body. The reflector surface comprises two thin elongate strips of metal (12) which are received in a recess (14) in the body (10) on one side, at or close to the centre line passing through the reflector and at the other side of their width by a clamp (13). The metal strips (12) are made from a heat-resistant flexible metal such as stainless steel or aluminum and typically have a thickness of from about 0.2 to about 0.6 mm, preferably 0.3 mm. The strips need not be continuous but may be a series of contiguous sections arranged lengthwise of the lamp housing.

The reflector strips are releasably clamped in position by means of the clamps (13) pressing on one edge and the edges of the recess (14) holding the other side of the width strip. This pressure causes the strips to be deformed so that they are pressed in intimate contact with the surface of the body. A heat-conductive paste, e.g. a silicone paste, may be squeezed between the two surfaces to ensure good thermal contact. Water jackets (11) are constructed so that they lie close to the metal strips (12), thereby more effectively cooling by conducting heat away from the metal strips.

The metal strips themselves carry a dichroic film which acts as a selective filter and reflector. This film is applied by vapour deposition in a controlled thickness. The principles of dichroic beam splitting or filters are described in the book by H. A. Macleod "Thin Film Optical Filters", published by Hilger, see especially page 309. The technique for depositing dichroic films is described by Bowmeister & Pincus on pages 58 to 75 of Scientific American (223), December 1970. The film or coating forms an optical interference layer on the stainless steel substrate. By applying uniform films of alternate low and high refractive index, a quarter wave stack can be produced in which the film has the same optical thickness as a quarter wavelength in the UV band, e.g. 350~400 nm. In this way, the film will exhibit maximum reflectance in the UV wavelengths, and the maximum transmittance in the infra-red bands. The dichroic coating is produced so as to reflect a majority of light in the 240 ~400 nanometer waveband, generally more than 80%, and preferably more than 90%. At the same time, the coating should transmit the majority of incident I.R. radiation and reflect less than 30%, preferably less than 25%, of radiation in the 450~2000 nanometer waveband.

Various materials can be used to form the dichroic filter layer. These include metal oxides and high temperature resistant salts such as fluorides. In one embodiment, the filter can be formed by alternate layers of silicon dioxide and hafnium dioxide layers. The layers are vapour deposited onto the sheet metal using a vacuum chamber and an electron beam gun to vaporise the coating material By using a vacuum chamber having two electron guns, each focused on a crucible containing one or more of the two coating materials, alternate layers can be deposited. An oscillating circuit may be employed to energise the two electron guns alternately. Coating may be continued until a substantial number of layers have been deposited, e.g. 50 to 100 layers.

A heat-absorbing coating may be applied to the metal surface prior to the coating with the dichroic filter film. Typical coatings are copper, nickel or chromium which are conveniently applied by electroplating.

In the embodiment described, the lamp is essentially water-cooled but a passageway (15) is arranged within the housing to provide for a curtain of compressed air to be emitted from slots or holes (16) so as to blow air over the lamp envelope itself. The slots or holes (16) are angled so as to direct a curtain of air into the gap between the reflective surface and the lamp envelope as shown by the single-headed arrows. This air movement creates a venturi effect on the other side of the envelope, causing air to be sucked into the corresponding gap on the other side, as indicated by the double-headed arrows. As a result, air circulates substantially co-axially around the lamp and this results in an important cooling effect on the lamp. This has the further advantage of keeping the lamp free from deposits of ink which can sometimes be carried in the airstream towards the lamp.

The dichroic filter coating on the reflector helps to keep the reflector clean because it lowers its temperature, thereby causing less degradation of deposits of ink and other stray materials derived from materials being printed or the inks.

Water-cooling is provided by pipes connected to apertures (20) in a heat sink block. Apertures (20) are connected to passages (21) via O-ring seals. Passages (21) are connected to passages (22) passing through the pivot points of the shutter blades, thereby causing water to flow through the pivot points and cooling the shutters themselves. The heat sink may include a cross-bore (23) which connects the water supply to passages (25) formed in a block (26) in the base of the housing.

Additional connections are made to the passages (11) in the body of the reflector housing (10). Suitable valves may be included between these connections in order to regulate the relative flow of water through different parts of the cooling system.

It will be seen from FIG. 3 that the invention enables the dryer to be constructed in a very compact form. This extends the number of printing machines which can be fitted with UV dryers and increases the speed at which such machines can be operated using UV ink drying.

FIG. 3 is drawn essentially to full size and it can be seen that a reflector opening of about 55 to 60 mms is employed using a UV lamp having a lamp envelope of about 35–40 mms diameter. The lamp will be about 1 meter long and have an output of about 25 KW.

Tests have shown that using the construction described above, the UV dryer operates with about 50% less I.R radiation reflected back into the lamp and a significantly greater proportion of UV radiation reflected. As a result, the temperature measured beneath the web was reduced from about 250° C. to 180° C.

I claim:

1. A UV dryer for drying photopolymerisable ink on a web wherein a UV lamp (2) is supported within a reflector housing (1), said housing including a reflector body (10) having curved reflector surfaces disposed to reflect UV light onto a web, characterised in that each of the reflector surfaces comprises a thin, flexible heat conductive metal strip (12), bearing a dichroic film on one side which is adjacent the lamp and wherein the strip is deformed so that the opposite side is in close contact with said reflector body, said dichroic film exhibiting a high degree of transmission towards infra-red radiation and a high degree of reflection towards UV radiation and said reflector body having other surfaces spaced from said reflector surfaces and cooling means are provided for passing a cooling medium over said other surfaces to cool the reflector body.

2. A dryer as claimed in claim 1 in which the flexible metal strip is held in position on said reflector body (10) by engaging one edge of the strip (12) in a recess (14) and deforming the strip into intimate contact with the reflector body by a clamp (13).

3. A dryer as claimed in claim 1 or 1 wherein the thin, flexible metal strips have a thickness of from 0.2 to 0.6 mm.

4. A dryer as claimed in claim 1 wherein the dichroic film reflects more than 80% of incident radiation in the wavelength band 240~400 nanometers and reflects less than 30% of incident radiation in the wavelength band 450–2000 nanometers.

5. A dryer as claimed in claim 1 in which the cooling medium is water.

6. A dryer as claimed in claim 1 which includes lamp cooling means for detecting an air stream over the lamp, wherein the air stream is directed between the reflective surface at one side of the lamp and the lamp envelope, thereby causing cooling air to circulate around the lamp envelope.

7. A dryer as claimed in claim 1 wherein said other surfaces are internal passages in the reflector body member for circulating cooling water therethrough.

8. A dryer as claimed in claim 1 wherein the reflector has a mouth which is closeable by at least one pivoting shutter and wherein the shutter is cooled by passing cooling water through a hollow pivot for the shutter.

* * * * *